US011391040B2

(12) United States Patent
Gandolfo et al.

(10) Patent No.: US 11,391,040 B2
(45) **Date of Patent: *Jul. 19, 2022**

(54) SELF-SEALING MEMBRANE SLEEVE ASSEMBLY

(71) Applicant: Specified Technologies Inc., Somerville, NJ (US)

(72) Inventors: Paul Gandolfo, Doylestown, PA (US); Michael Joyce, Levittown, PA (US)

(73) Assignee: Specified Technologies Inc., Somerville, NJ (US)

( * ) Notice: Subject to any disclaimer, the term of this patent is extended or adjusted under 35 U.S.C. 154(b) by 97 days.

This patent is subject to a terminal disclaimer.

(21) Appl. No.: 16/919,709

(22) Filed: Jul. 2, 2020

(65) Prior Publication Data

US 2020/0332519 A1 Oct. 22, 2020

Related U.S. Application Data

(63) Continuation-in-part of application No. 16/249,108, filed on Jan. 16, 2019, now Pat. No. 11,209,083.

(60) Provisional application No. 62/618,723, filed on Jan. 18, 2018.

(51) Int. Cl.
*E04B 1/94* (2006.01)
*E04B 1/66* (2006.01)

(52) U.S. Cl.
CPC ..... *E04B 1/948* (2013.01); *E04B 1/66* (2013.01)

(58) Field of Classification Search
CPC ..... F16L 5/04; F16L 5/10; F16L 5/14; H02G 3/22; A62C 2/065; E04B 2002/7488; E04B 2/7411; E04B 2/7457; E04B 1/947; E04B 5/48
See application file for complete search history.

(56) References Cited

U.S. PATENT DOCUMENTS 2,832,406 A * 4/1958 Turenne ..... E06B 7/32 160/179
4,350,198 A * 9/1982 Naegeli ..... E06B 7/32 160/179
4,938,169 A * 7/1990 Barmakian ..... A01K 1/035 119/484
6,928,777 B2 * 8/2005 Cordts ..... H02G 3/0412 52/220.8

* cited by examiner

*Primary Examiner* — Gilbert Y Lee
(74) *Attorney, Agent, or Firm* — Massina Pat. & TM Law PLLC

(57) ABSTRACT

A self-sealing membrane sleeve assembly including a sleeve member having a tubular body extending between first and second ends. At least one shield assembly extends about at least a portion of the circumference of the sleeve member from the first end to the second end. The at least one shield assembly made from a generally rigid, fire resistant material. A first sealing membrane assembly is secured to the first end of the tubular body and a second sealing membrane assembly is secured to the second end of the tubular body.

20 Claims, 14 Drawing Sheets

SELF-SEALING MEMBRANE SLEEVE ASSEMBLY

This application claims the benefit of U.S. Provisional Appln. No. 62/618,723, filed on Jan. 18, 2018, and claims priority to U.S. application Ser. No. 16/249,108, filed on Jan. 16, 2019, the contents of each of which are incorporated herein by reference.

FIELD OF THE INVENTION

The invention generally relates to apparatus for providing sealing of a construction opening and, more particularly, to a sealing membrane sleeve assembly configured to form a seal about penetrating members passing through the construction opening. In some embodiments, the sealing membrane sleeve assembly is configured for fire-rated applications.

BACKGROUND OF THE INVENTION

It is commonplace in the construction and renovation of commercial and residential buildings for the need to pass cables, conduits and the like through construction barriers such as walls, floors and ceilings. However, the presence of an opening through such barriers provides a potential passage for smoke and noise.

Often the openings will include a sleeve extending therethough to guide passage of cables or the like. The sleeves are typically short lengths of metal conduit, pipe, or EMT that project through a barrier. The NEC (NFPA 70) defines a sleeve to be a short length of raceway used to support and protect cables. While the sleeves support and protect the cables, the opening therethrough still may allow for passage of smoke and noise.

While there have been attempts to seal the ends of the sleeve, many such attempts often have difficulty maintaining a proper seal as cable moves, adds, and changes are made to the structured cabling. Accordingly, there is a need for a sleeve sealing assembly that adjusts to and maintains a proper seal even as the number and size of cables passing therethrough changes.

Additionally, many building codes mandate the use of fire-resistant materials in construction, especially if portions of the building are open to the public or shared commons. For public spaces and commercial applications, fire-rated products which, in addition to preventing passage of smoke and noise, also help prevent the passage of fire and heat are generally required.

SUMMARY OF THE INVENTION

In at least one embodiment, the present invention provides a sealing membrane assembly including a flange having a body with a through passage. A first sealing membrane defines a first flexible panel with a first axial sealed opening extending therethrough. The first axial sealed opening extends at an acute angle. A second sealing membrane defines a second flexible panel with a second axial sealed opening extending therethrough. The second axial sealed opening extends at an obtuse angle. The first and second sealing membranes are secured relative to the flange such that the first and second axial sealed openings crisscross one another and the first and second sealing membranes seal the through passage except through the first and second sealed openings.

In at least one embodiment, the present invention provides a self-sealing membrane sleeve assembly including a sleeve member having a tubular body extending between first and second ends. A first sealing membrane assembly is secured to the first end of the tubular body and a second sealing membrane assembly is secured to the second end of the tubular body. The first and second sealing membranes each include a flange having a body with a through passage. A first sealing membrane defines a first flexible panel with a first axial sealed opening extending therethrough. The first axial sealed opening extends at an acute angle. A second sealing membrane defines a second flexible panel with a second axial sealed opening extending therethrough. The second axial sealed opening extends at an obtuse angle. The first and second sealing membranes are secured relative to the flange such that the first and second axial sealed openings crisscross one another and the first and second sealing membranes seal the through passage except through the first and second sealed openings.

In at least one embodiment, the present invention provides a self-sealing membrane sleeve assembly including a sleeve member having a tubular body extending between first and second ends. At least one shield assembly extends about at least a portion of the circumference of the sleeve member from the first end to the second end. The at least one shield assembly made from a generally rigid, fire resistant material. A first sealing membrane assembly is secured to the first end of the tubular body and a second sealing membrane assembly is secured to the second end of the tubular body. The first and second sealing membranes each include a flange having a body with a through passage. A first sealing membrane defines a first flexible panel with a first axial sealed opening extending therethrough. The first axial sealed opening extends at an acute angle. A second sealing membrane defines a second flexible panel with a second axial sealed opening extending therethrough. The second axial sealed opening extends at an obtuse angle. The first and second sealing membranes are secured relative to the flange such that the first and second axial sealed openings crisscross one another and the first and second sealing membranes seal the through passage except through the first and second sealed openings.

In at least one embodiment, the present invention provides a self-sealing membrane sleeve assembly including a sleeve member having a tubular body extending between first and second ends. At least one intumescent pad is positioned within the tubular body. A first sealing membrane assembly is secured to the first end of the tubular body and a second sealing membrane assembly is secured to the second end of the tubular body. The first and second sealing membranes each include a flange having a body with a through passage. A first sealing membrane defines a first flexible panel with a first axial sealed opening extending therethrough. The first axial sealed opening extends at an acute angle. A second sealing membrane defines a second flexible panel with a second axial sealed opening extending therethrough. The second axial sealed opening extends at an obtuse angle. The first and second sealing membranes are secured relative to the flange such that the first and second axial sealed openings crisscross one another and the first and second sealing membranes seal the through passage except through the first and second sealed openings.

BRIEF DESCRIPTION OF THE DRAWINGS

The accompanying drawings, which are incorporated herein and constitute part of this specification, illustrate the presently preferred embodiments of the invention, and, together with the general description given above and the detailed description given below, serve to explain the features of the invention. In the drawings.

DETAILED DESCRIPTION OF THE INVENTION

Figure 1:
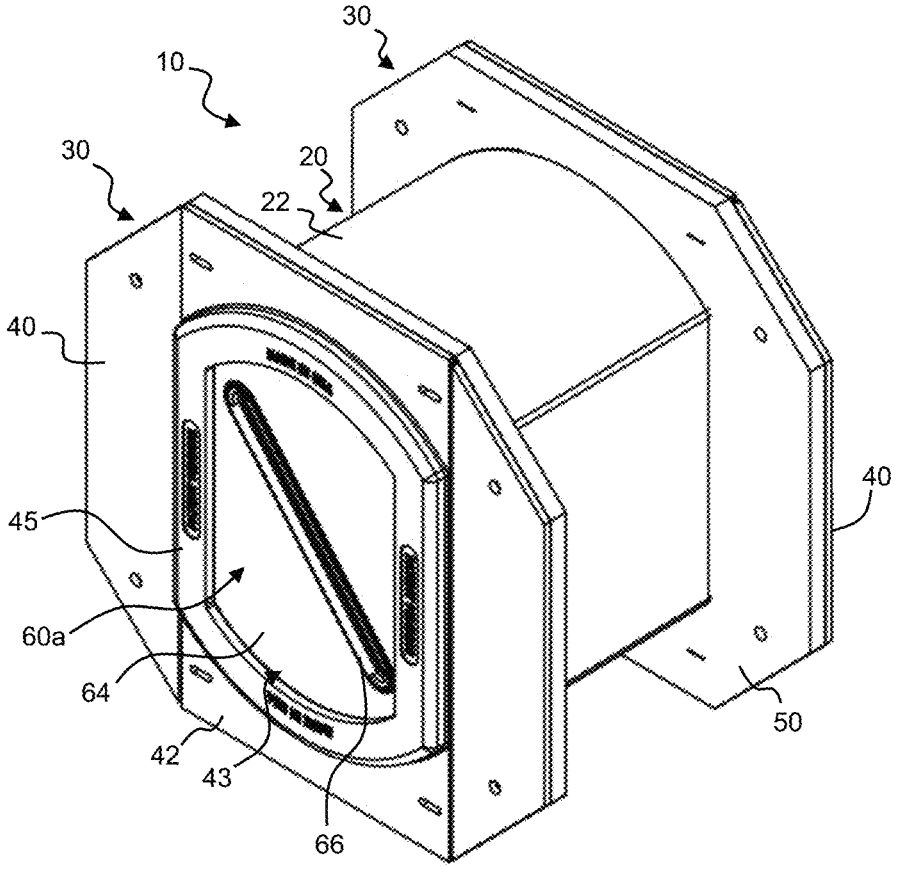
FIG. 1 is a front perspective view of an exemplary self-sealing membrane sleeve assembly in accordance with an embodiment of the invention.
Figure 2:
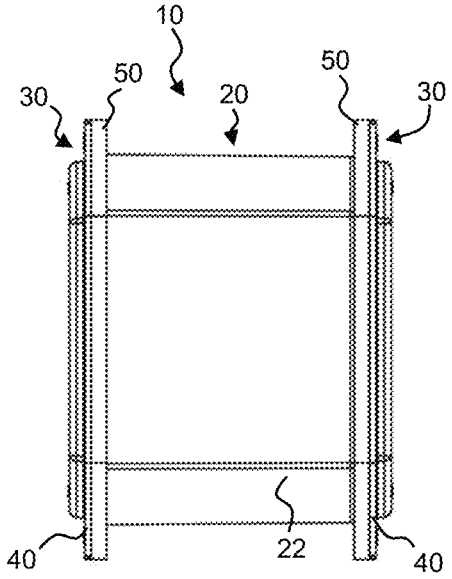
FIG. 2 is a side elevation view of the self-sealing membrane sleeve assembly of FIG. 1 in a contracted configuration.
Figure 3:
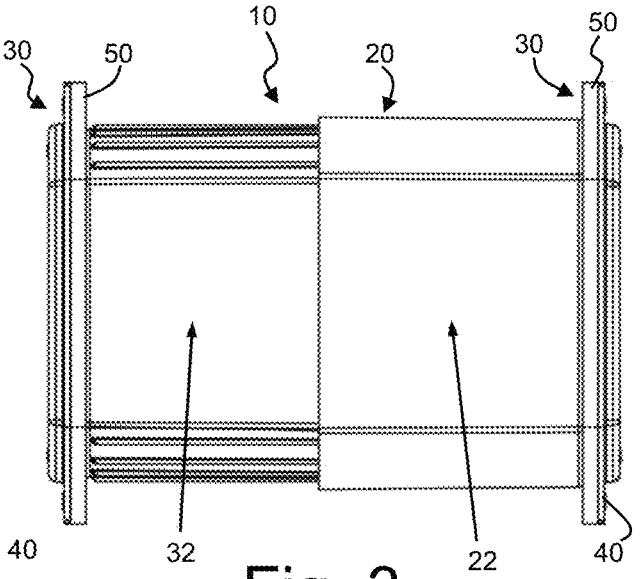
FIG. 3 is a side elevation view of the self-sealing membrane sleeve assembly of FIG. 1 in an expanded configuration.

In the drawings, like numerals indicate like elements throughout. Certain terminology is used herein for convenience only and is not to be taken as a limitation on the present invention. The following describes preferred embodiments of the present invention. However, it should be understood, based on this disclosure, that the invention is not limited by the preferred embodiments described herein.

Referring to FIGS. 1-13, a self-sealing membrane sleeve assembly 10 in accordance with an exemplary embodiment of the invention will be described. In the illustrated embodiment, the assembly 10 generally includes a sleeve member 20 positioned between a pair of sealing membrane assemblies 30. As will be described in more detail hereinafter, the sleeve member 20 of the illustrated embodiment has a telescoping configuration with an outer portion 22 and an inner portion 32. However, the invention is not limited to such and the sleeve member 20 may have various configurations, for example, a continuous tubular body, and various shapes, for example, oval, circular, square or the like. While the illustrated embodiment is described as a sleeve assembly including the sealing membrane assemblies 30 and the sleeve member 20, the sealing membrane assemblies 30 may be configured to engage and secure to the ends of pre-existing sleeve members. Additionally, while the illustrated embodiment is described in terms of providing smoke and acoustical protection, it is recognized that the assembly will also provide protection against passage of fire and superheated gases. Additionally, the assembly could also integrate intumescent materials, for example, positioned in the sleeve or supported by the flanges, to provide a fire-rated version of the assembly. An embodiment incorporating such features is described with respect to FIGS. 18-24.

Referring to FIGS. 2-6, an exemplary sleeve member 20 will be described. In this embodiment, the sleeve member 20 has a telescoping configuration with an outer portion 22 and an inner portion 32. The telescoping configuration of the sleeve member 20 allows the sleeve member 20 to expand to any length between the contracted configuration illustrated in FIG. 2 and the expanded configuration illustrated in FIG. 3. Such a configuration allows the assembly 10 to be utilized with walls or other structures of different widths or thicknesses.

Figure 4:
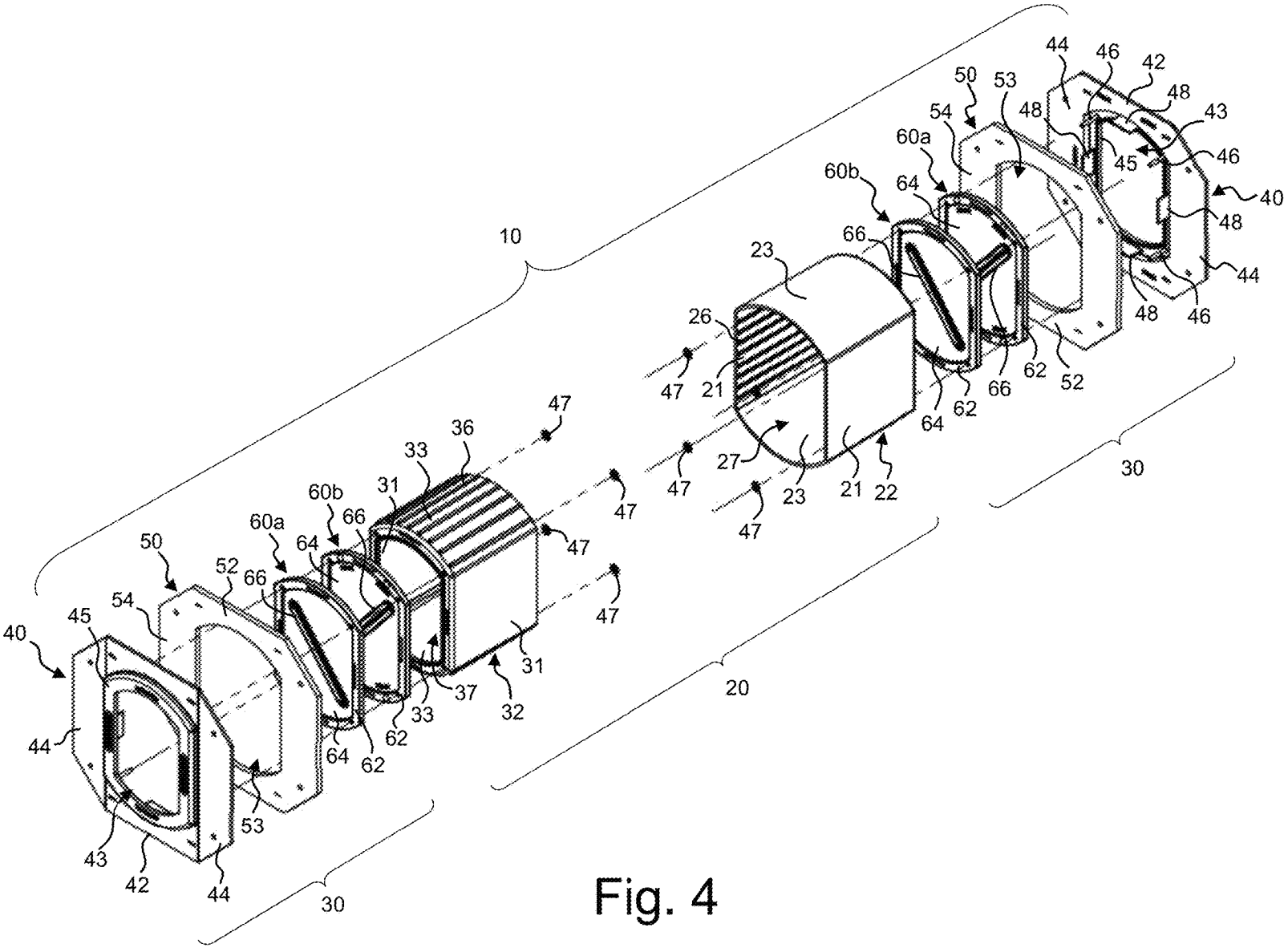
FIG. 4 is an exploded perspective view of the self-sealing membrane sleeve assembly of FIG. 1.
Figure 5:
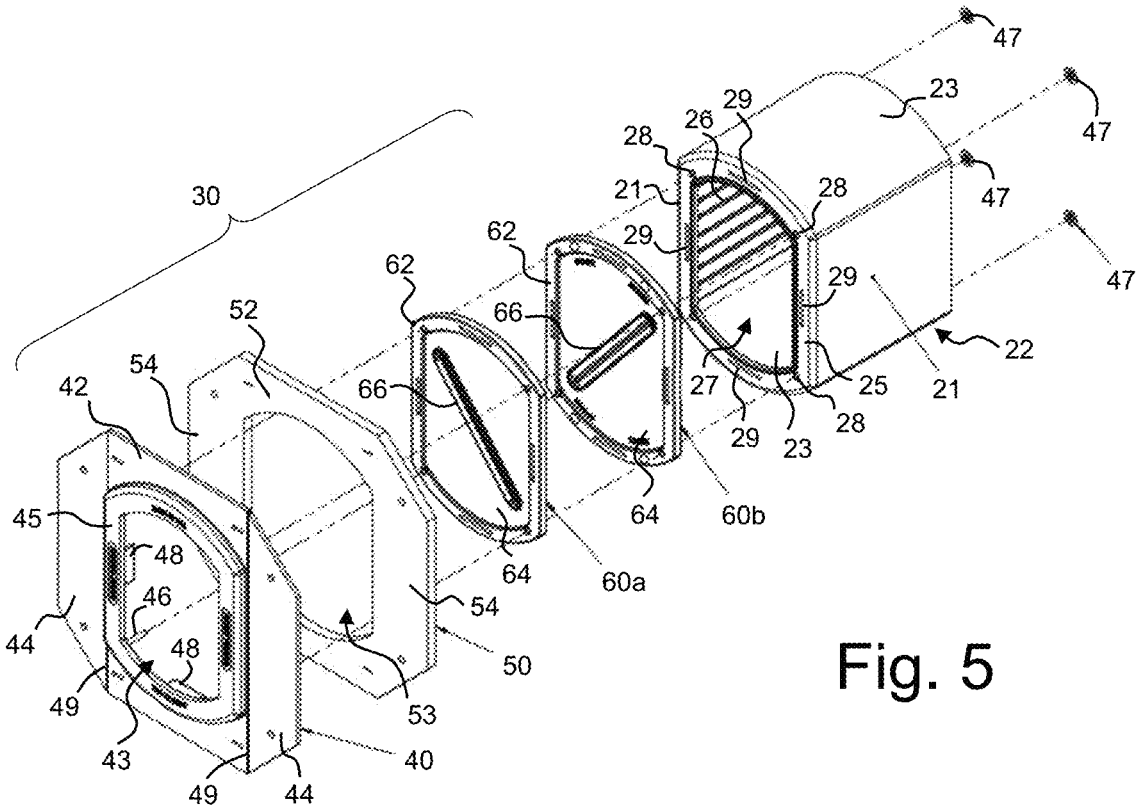
FIG. 5 is an exploded perspective view of an outer portion of an exemplary sleeve member and an exemplary sealing membrane assembly.
Figure 6:
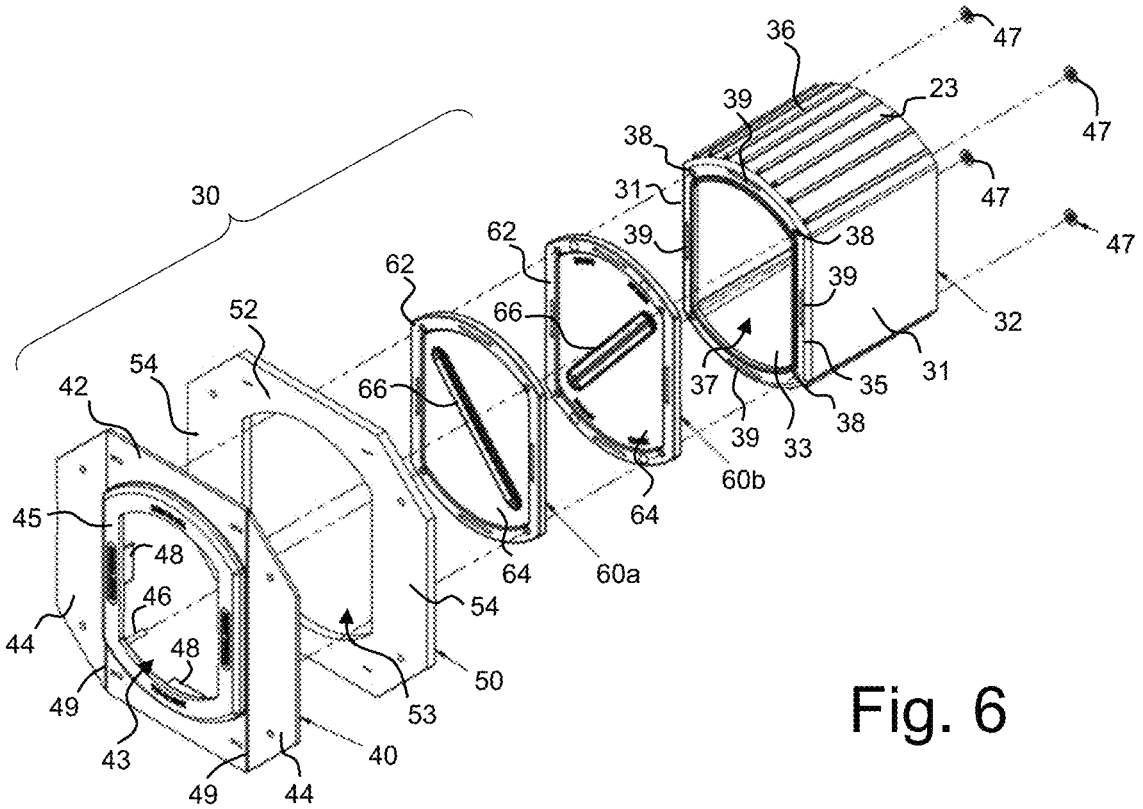
FIG. 6 is an exploded perspective view of an inner portion of the exemplary sleeve member and an exemplary sealing membrane assembly.
Figure 7:
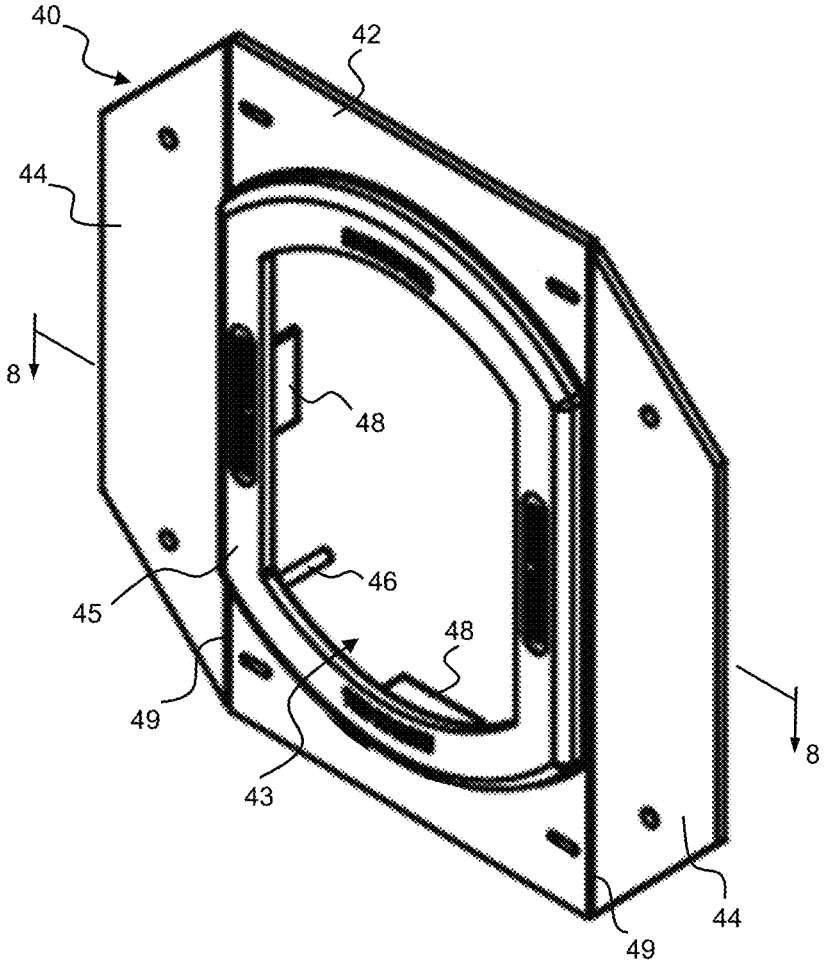
FIG. 7 is a perspective view of an exemplary flange.
Figure 8:
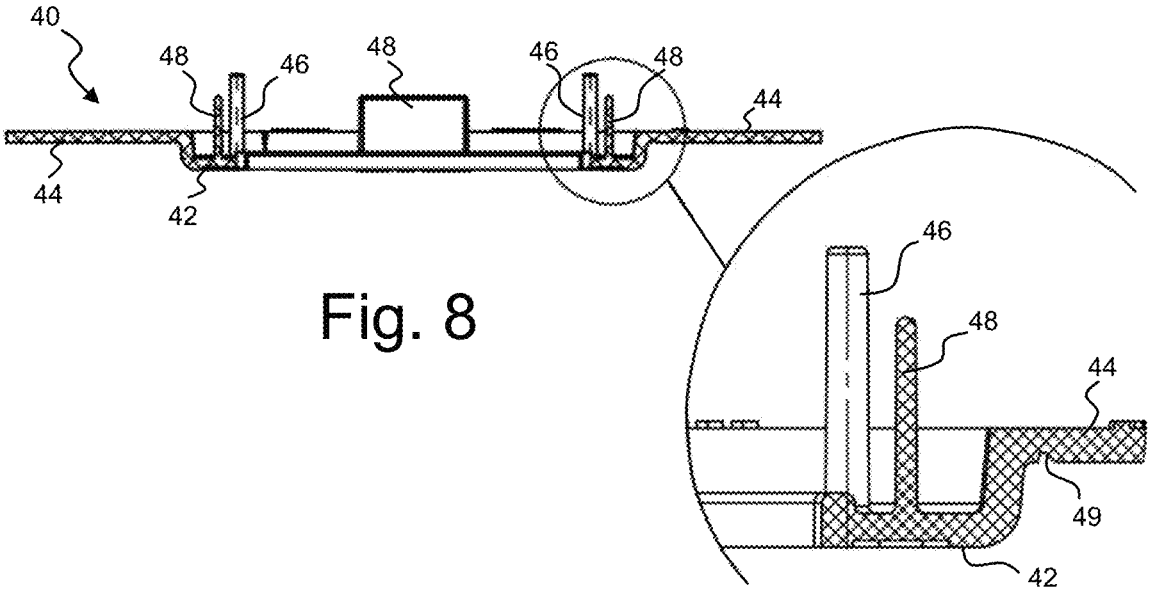
FIG. 8 is a cross-sectional view along the line 8-8 in FIG. 7, with a portion thereof shown in an expanded view.

The telescoping sleeve member 20 will be described in more detail with reference to FIGS. 4-6. The outer portion 22 of the sleeve member 20 includes opposed side walls 21 extending between top and bottom walls 23 with a passage 27 therethrough. While the illustrated embodiment includes linear side walls 21 and arcuate top and bottom walls 23 to define an oval shape, the invention is not limited to such and the outer portion 22 may have any desired shape. Similarly, the inner portion 32 of the sleeve member 20 includes opposed side walls 31 extending between top and bottom walls 33 with a passage 37 therethrough. The inner portion 32 has a configuration which compliments the outer portion 22 such that the inner portion 32 slides within the passage 27 of the outer portion 22 such that the length of the sleeve member 20 is telescopically adjustable. In the illustrated embodiment, the side walls 21 have internal ribs 26 and the top and bottom walls 33 have external ribs 36. The ribs 26, 36 provide a friction fit between the outer and inner portions 22, 32 to maintain the sleeve member 20 in an assembled configuration. The linearly outer end of each portion 22, 32 defines a respective support face 25, 35 configured to support a respective flange 40. In the illustrated embodiment, each support face 25, 35 has a plurality of connector openings 28, 38 and a plurality of tab openings 29, 39, the functions of which will be described in more detail below.

Referring to FIGS. 5-11, an exemplary sealing membrane assembly 30 will be described. The sealing membrane assembly 30 generally includes a mounting flange 40 and a pair of sealing membranes 60*a*, 60*b*. While a pair of sealing membranes is illustrated, more or fewer than two sealing membranes may be utilized. As illustrated, a foam gasket 50 may be supported by the flange 40 to seal between the structure opening and the assembly (see FIGS. 12 and 13).

Figure 12:
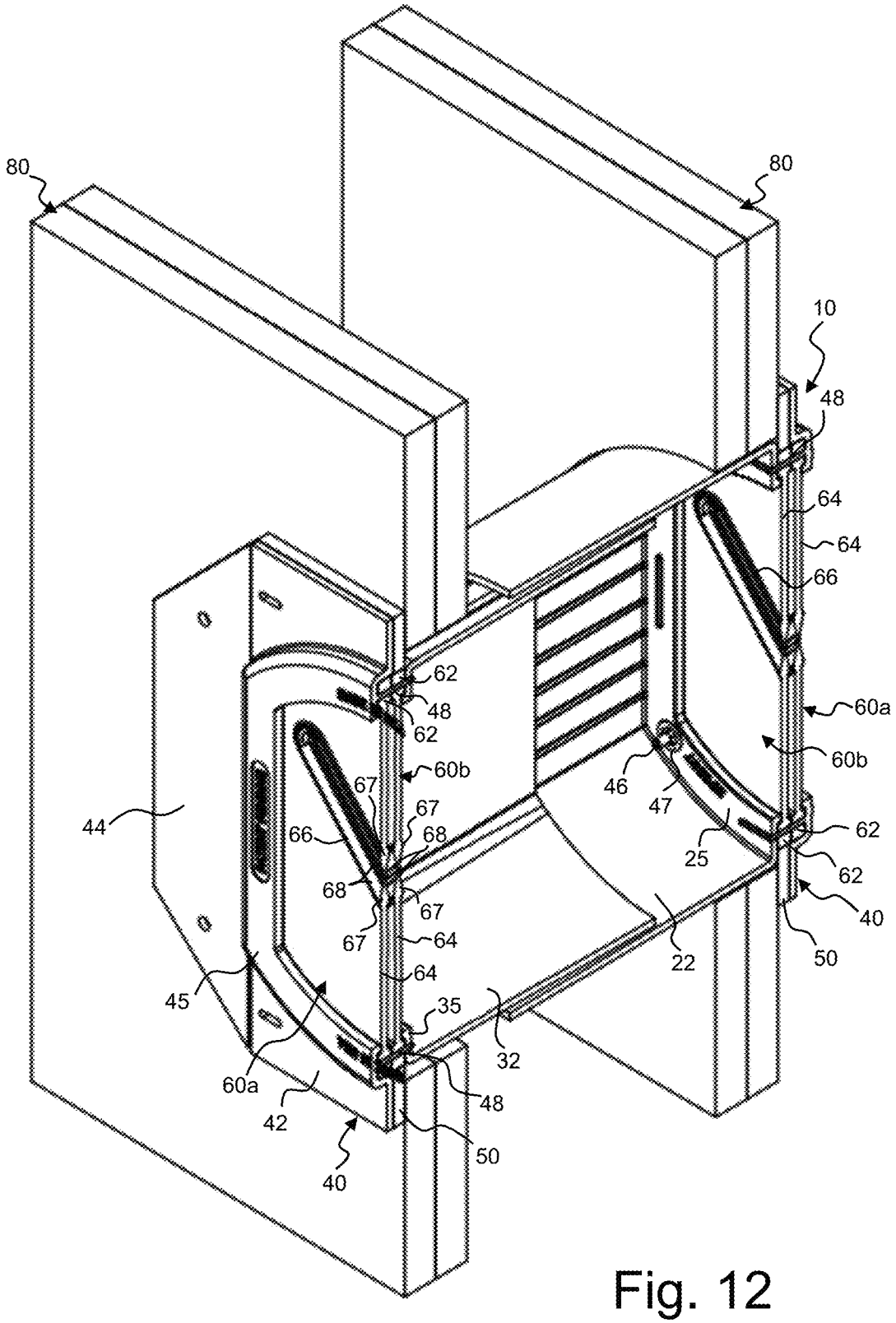
FIG. 12 is a cross-sectional perspective view of a self-sealing membrane sleeve assembly positioned within an opening in a wall structure.
Figure 13:
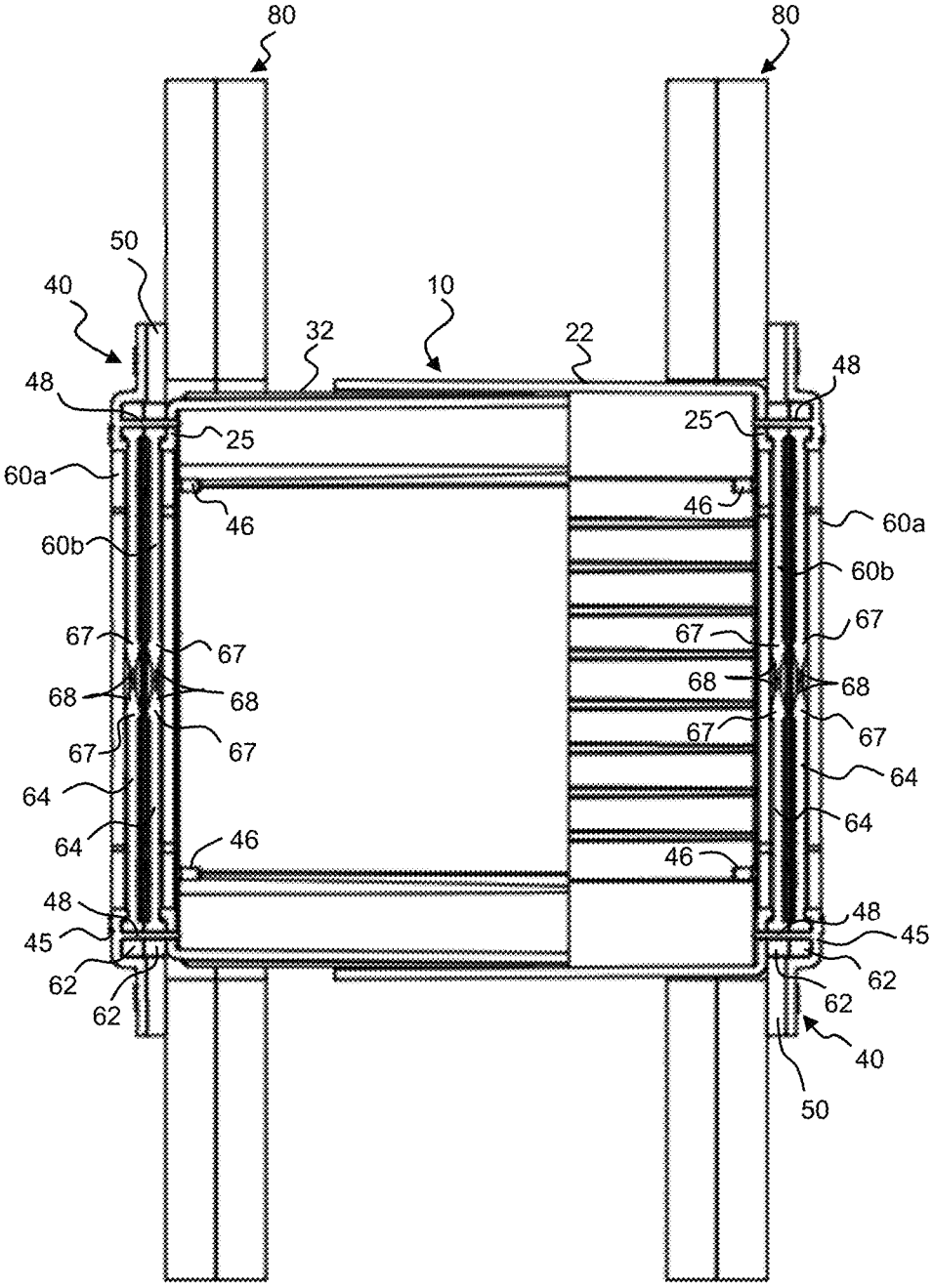
FIG. 13 is a cross-sectional elevation view of a self-sealing membrane sleeve assembly positioned within an opening in a wall structure.

Each flange 40 includes a body 42 extending about a through passage 43. In the illustrated embodiment, the body 42 includes score lines 49 which define breakoff tabs 44 which may facilitate ganging of multiple assemblies 10 as will be describe hereinafter. The body 42 defines a projecting portion 45 about the through passage 43, with the projecting portion 45 configured to house one or both of the sealing membranes 60*a*, 60*b*. With reference to FIGS. 12 and 13, in the illustrated embodiment one of the sealing membranes 60*a* is positioned within the projection 45 while the other sealing membrane 60*b* is surrounded by the foam gasket 50.

Each flange 40 includes a plurality of connector pins 46 and alignment tabs 48 extending linearly inward. Each of the connector pins 46 is configured to be engaged by a respective push-on nut 47 or the like. The connector pins 46 are configured to extend through openings 61 in each sealing membrane 60*a*, 60*b* and through a respective connector opening 28, 38. The portion of the pin 46 extending into the respective sleeve portion is engaged by a respective push-on nut 47 which engages the inside surface of the respective support face 25, 35 and thereby mounts the flange 40 to the respective sleeve portion 22, 32 (see FIG. 12). While connector pins and push-on nuts are illustrated herein, the invention is not limited to such and other mounting mechanisms, for example, screws, clips or the like may be utilized.

The alignment tabs 48 preferably have a wide configuration and extend through slots 63 in each of the sealing membranes 60*a*, 60*b* and into a respective tab opening 29, 39. The alignment tabs 48 thereby maintain the alignment of the sealing membranes 60*a*, 60*b* and prevent twisting or the like thereof when cables are passed therethrough. The flanges 40 are preferably made out of a thermoplastic material with properties that provide excellent impact properties and flame retardancy, however, the invention is not limited to such and the flanges may be made from other materials.

Each of the foam gaskets 50 includes a body 52 with a through passage 53. The through passage 53 may be slightly larger than the through opening 43 of the flange 43 such that the tabs 48 extend through the through passage 53 and support the gasket 50 relative to the flange 40 during assembly. The gasket body 52 has a configuration which complements the configuration of the flange 40. The sides 54 of the gasket body 52 may be trimmed to match the flange 40 if one or both of the tabs 44 are snapped off. The gasket 50 is preferably made from a flame retardant material, for example, a closed cell flame retardant Neoprene, which is designed to seal between the flange 40 and the wall opening restricting the passage of smoke and sound.

Figure 9:
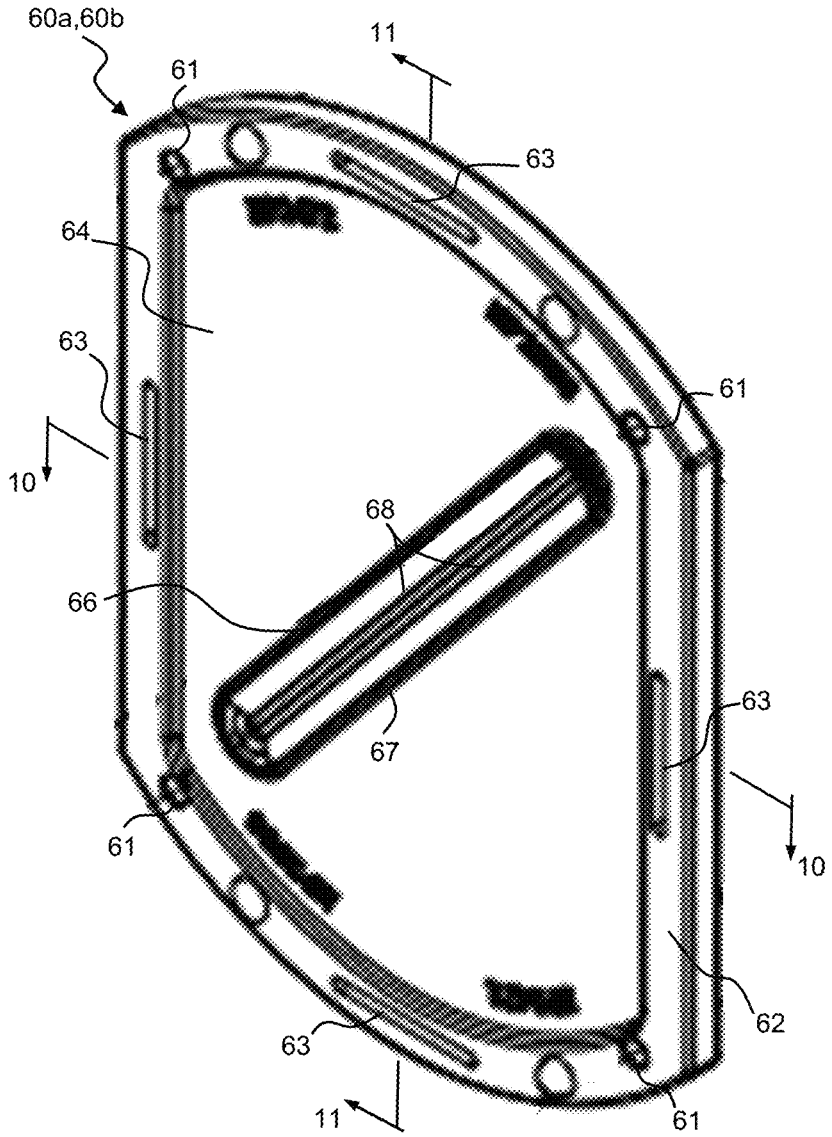
FIG. 9 is a perspective view of an exemplary sealing membrane.
Figure 10:
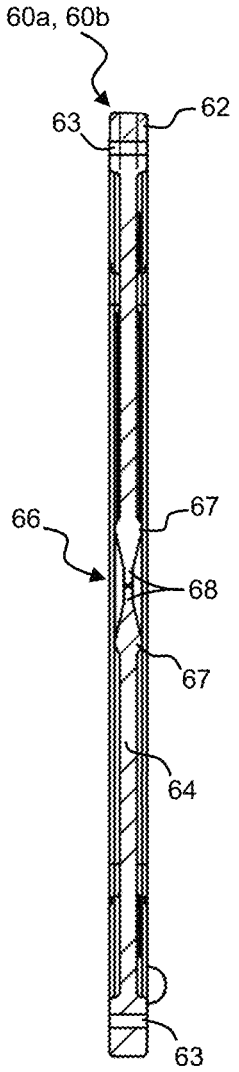
FIG. 10 is a cross-sectional view along the line 10-10 in FIG. 9.
Figure 11:
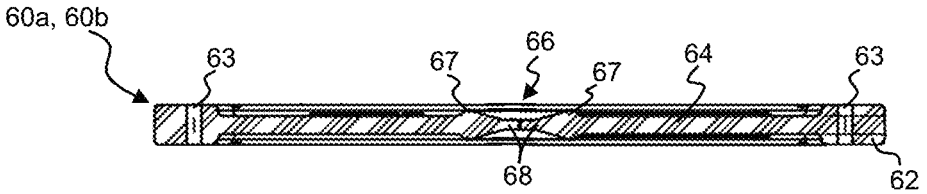
FIG. 11 is a cross-sectional view along the line 11-11 in FIG. 9.

Referring to FIGS. 9-11, an illustrative sealing membrane 60*a*, 60*b* will be described. The sealing membranes 60*a*, 60*b* are manufactured from a flexible material, preferably having a very low compression set and high elongation. An exemplary material is a Silicone based thermoset material. The sealing membranes 60*a*, 60*b* preferably each have the same configuration but are installed opposite one another, e.g. back to back, such that the sealed openings 66 extend at opposite angles and crisscross one another. Since the sealing membranes 60*a*, 60*b* are installed back to back, the sealed opening 66 of one of the membranes 60*a* extends at an acute angle while the sealed opening 66 of the other membrane 60*b* extends at an obtuse angle, thereby having the crisscross configuration.

Each sealing membrane 60*a*, 60*b* includes an outer rim 62 of increased thickness for mounting of the sealing membrane 60*a*, 60*b*. The openings 61, 63 are defined within the rim 62. A flexible panel 64 extends within the rim 62 with the axial, angled sealed opening 66 defined therethrough. In the illustrated embodiment, each sealed opening 66 extends at an approximately 45° relative to a plane extending sideways across the flange 40. The invention is not limited to such and the sealed openings 66 may extend at a different angle larger or smaller acute angle. In the illustrated embodiment, each sealed opening 66 has an oval shape defined by a reinforced band 67, e.g. increased thickness, extending about sealing flaps 68 therein. The flexible reinforced band 67 provides mechanical support to keep the cable bundles passing therethrough centered. The oval shape creates a self-adjusting rubber band effect that is self-adjusting to varying sizes of cables and bundles. When the membranes 60*a*, 60*b* are installed in the proper manner they create bi axial contact around the bundle keeping the bundle centered and preventing a continuous path for air and sound to leak through. The axial orientation deflects and dissipates the smoke and sound, reducing transmission through the opening. To prevent improper installation, the sealing membranes 60*a*, 60*b* may include a feature, e.g. a keying feature, molded therein.

Having generally described the components of an illustrative self-sealing membrane sleeve assembly 10, an exemplary installation will be described with respect to FIGS. 5, 6, 12 and 13. Each sealing membrane assembly 30 is secured to a respective sleeve member portion 22, 32 by passing the connector pins 46 and tabs 48 through the gasket through passage 53, through the openings 61, 63 of a first sealing membrane 60*a* in a first orientation, through the openings 61, 63 of the second sealing membrane 60*b* in a second, opposite orientation and then through the respective openings 28, 38, 29, 39, after which the connector pins 46 are engaged by the push-on nuts 47. As shown in FIG. 12, once the push-on nuts 47 engage within the connector pins 46, the flange 40 is secured to the respective sleeve member portion 22, 32 with the rims 62 of the sealing membranes 60*a*, 60*b* secured therebetween. The sleeve portions 22, 32 are extended through an opening in the building structure 80 (e.g. wall) from opposite sides thereof such that the inner portion 32 is received in the outer portion 22. The sleeve member portions 22, 32 are moved toward one another until the flanges 40 press the gaskets 50 against the building structure 80, providing a seal between the building structure 80 and the assembly 10. Screws or the like (not shown) may optionally be utilized to further secure the flanges 40 to the building structure 80.

Figure 17:
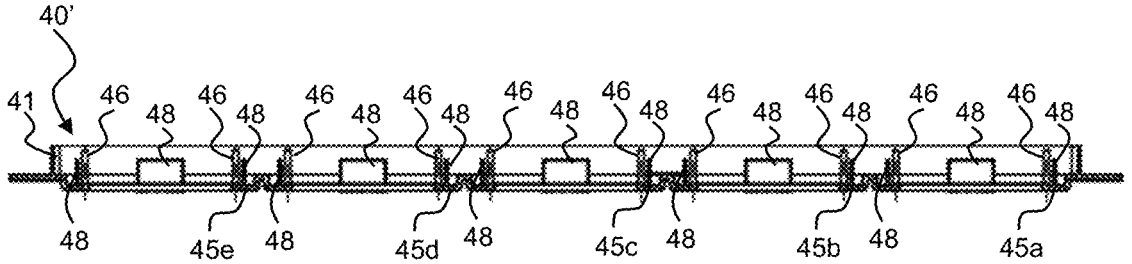
FIG. 17 is a cross-sectional view along the line 17-17 in FIG. 16.
Figure 18:
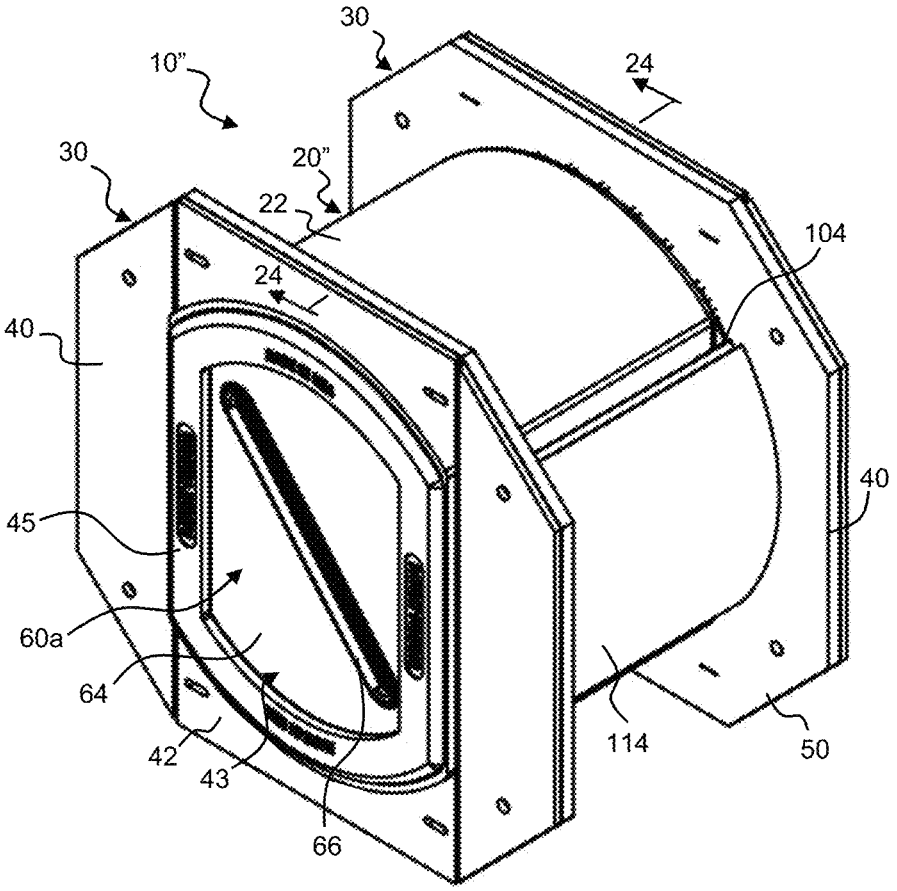
FIG. 18 is a front perspective view of an exemplary self-sealing membrane sleeve assembly in accordance with another embodiment of the invention.

Referring to FIGS. 14-17, a ganged self-sealing membrane sleeve assembly 10' will be described. In the illustrated embodiment, each flange 40' defines a plurality of projecting portions 45*a-e* extending about a respective through passage 43*a-e*. While the present embodiment shows five such projecting portions 45*a-e* and through passages 43*a*-3, the flange 40' may be configured with more or fewer projecting portions and through passages. The flange 40' is configured to support sealing membranes 60*a*, 60*b* and a respective sleeve portion 22*a*-22*e*/32*a*-32*e* in alignment with each through passage 43*a-e*. As illustrated in FIG. 17, the flange 40' defines a set of connector pins 46 and alignment tabs 48 within each projecting portion 45*a-e* to support the sealing membranes 60*a*, 60*b* and a respective sleeve portion 22*a*-22*e*/32*a*-32*e* in alignment with each through passage 43*a*-*e*. The flange 40' may include breakoff portion 44' to provide flexible configurations.

Figure 14:
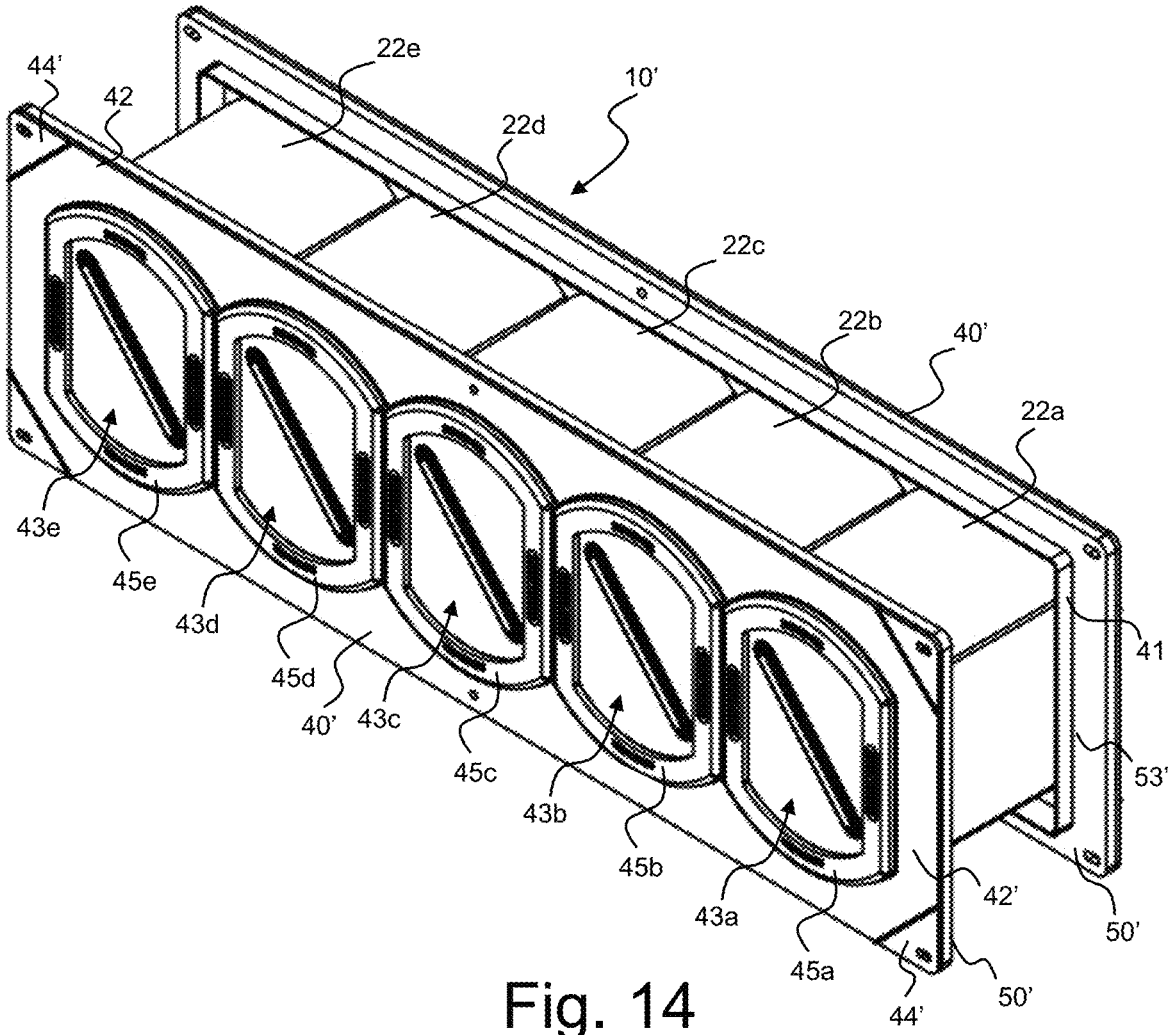
FIG. 14 is a perspective view of an exemplary ganged self-sealing membrane sleeve assembly in accordance with an embodiment of the invention.
Figure 15:
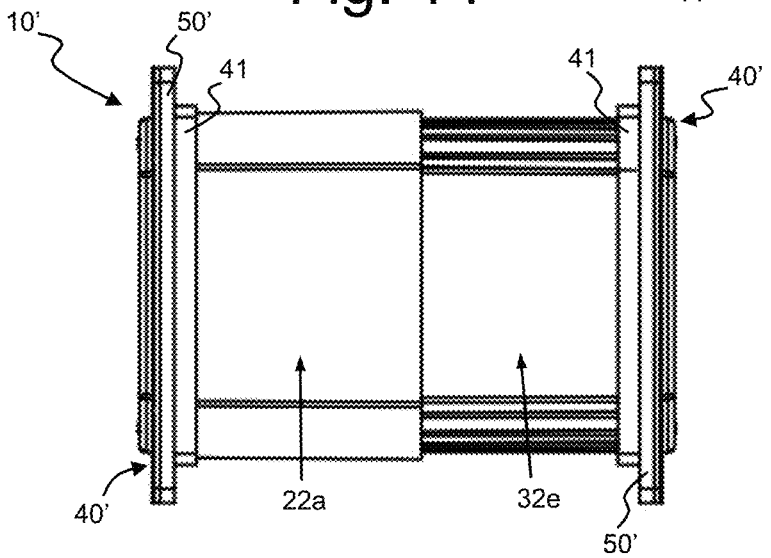
FIG. 15 is a side elevation view of the ganged self-sealing membrane sleeve assembly of FIG. 14 in an expanded configuration.
Figure 16:
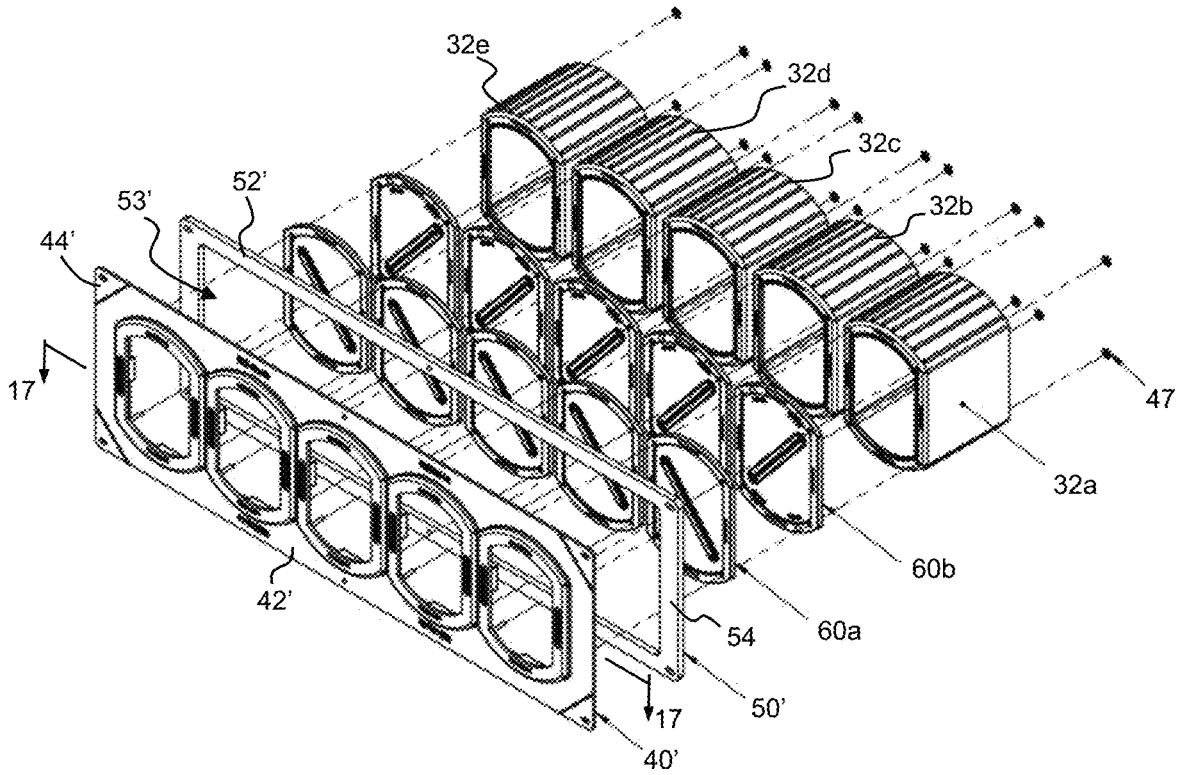
FIG. 16 is an exploded perspective view of an inner portion of the ganged self-sealing membrane sleeve assembly of FIG. 14.

To provide sealing about all of the through passages 43*a*-*e*, an internal rim 41 extends inward from the flange body 42 about each of the through passages 43*a*-*e* and the sleeve portions 22*a*-22*e*/32*a*-32*e* connected thereto (see FIG. 14). The sealing gasket 50' has a gasket body 52 which complements the configuration of the outer portion of the body 42' of the flange 40'. The gasket through passage 53' complements the configuration of the internal rim 41 such that the gasket 50' seals about the rim 41. In other aspects, the ganged self-sealing membrane sleeve assembly 10' is assembled and operates in a manner similar to the embodiment described above.

While the embodiment illustrated in FIGS. 14-17 includes a unitary flange to define a ganged assembly, it is also possible to form a ganged assembly utilizing multiple self-sealing membrane sleeve assemblies 10 as illustrated in FIG. 1 positioned next to one another. Each of the self-sealing membrane sleeve assemblies would be assembled as described above. To facilitate a tight ganging of the assemblies, a left most flange 40 would have its right breakoff tab 44 removed, each of the middle flanges 40 (however many are desired from zero to many) have both breakoff tabs 44 removed, and the right most flange 40 would have its left breakoff tab 44 removed. As explained above, the sides of the gaskets 50 may be trimmed to complement the flanges 40 when the breakoff tabs are removed.

Referring to FIGS. 18-24, another embodiment of the self-sealing membrane sleeve assembly 10" will be described. The sleeve assembly 10" is configured for use in applications requiring a fire-rated apparatus. The sleeve assembly 10" is substantially the same as in the first embodiment of the sleeve assembly 10 described above and only the differences will be described. The sleeve assembly 10" again includes a sleeve member 20" positioned between a pair of sealing membrane assemblies 30. The sealing membrane assemblies 30 are the same as in the previous embodiments. In the present embodiment, the sleeve member 20" further includes a pair of shield assemblies 100, 110 along with intumescent pads 103, 113 and 120. As in the previous embodiment, the sleeve member 20" of the illustrated embodiment has a telescoping configuration with the outer portion 22 slidable along the inner portion 32. In the present embodiment, the shield assemblies 100, 110 extend along the side walls 21 of the outer portion 22 in a telescoping manner. While sleeve member 20" is described with a telescoping configuration, it is understood that such is not required and the sleeve member 20" may have non-telescoping configurations.

Figure 19:
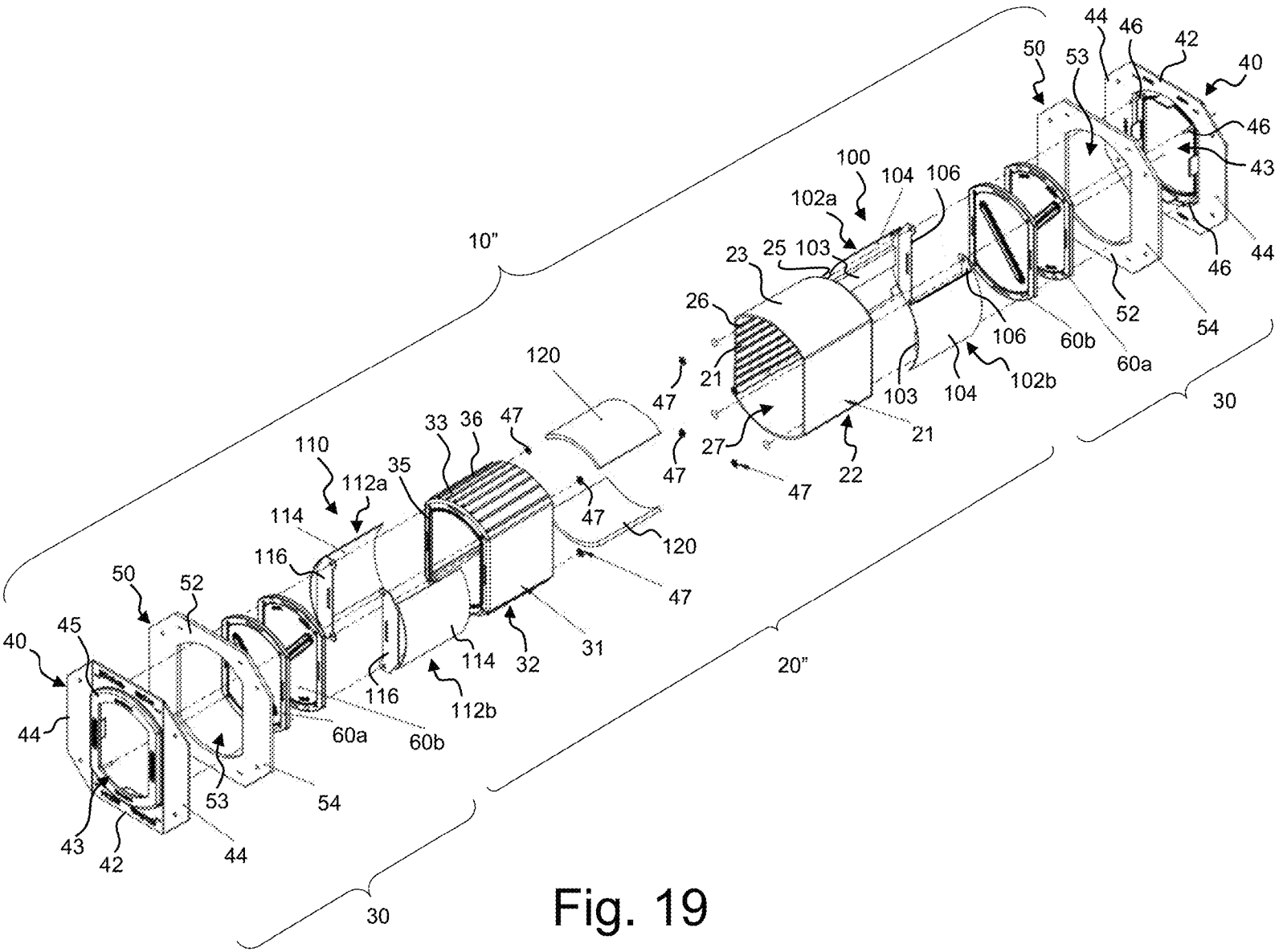
FIG. 19 is an exploded perspective view of the self-sealing membrane sleeve assembly of FIG. 18.
Figure 20:
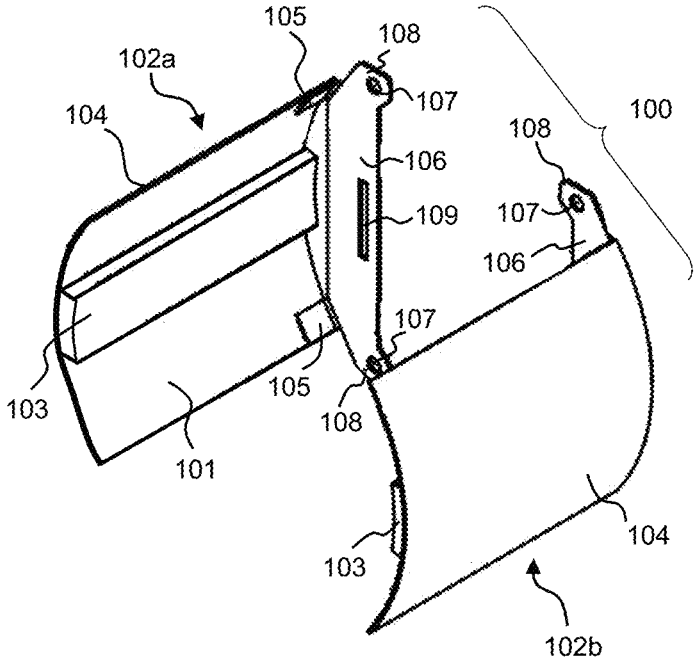
FIG. 20 is a perspective view of an illustrative inner shield assembly.
Figure 21:
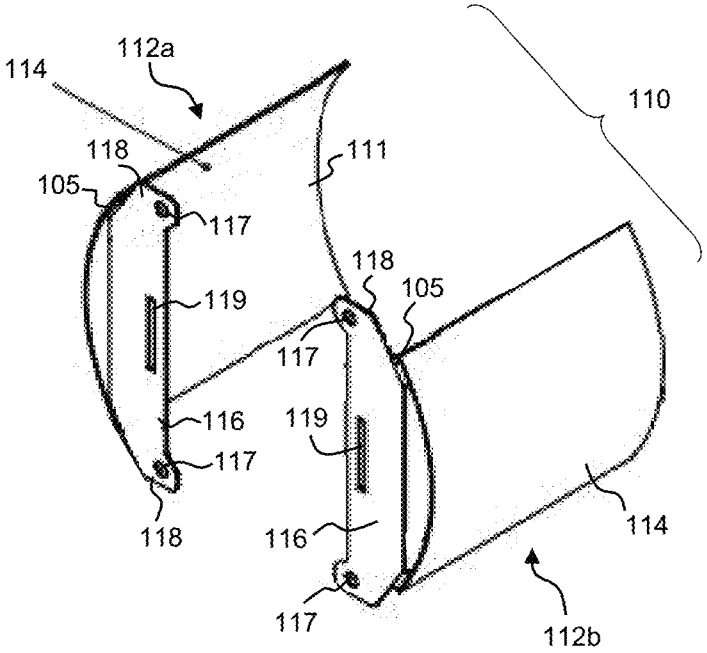
FIG. 21 is a perspective view of an illustrative outer shield assembly.
Figure 22:
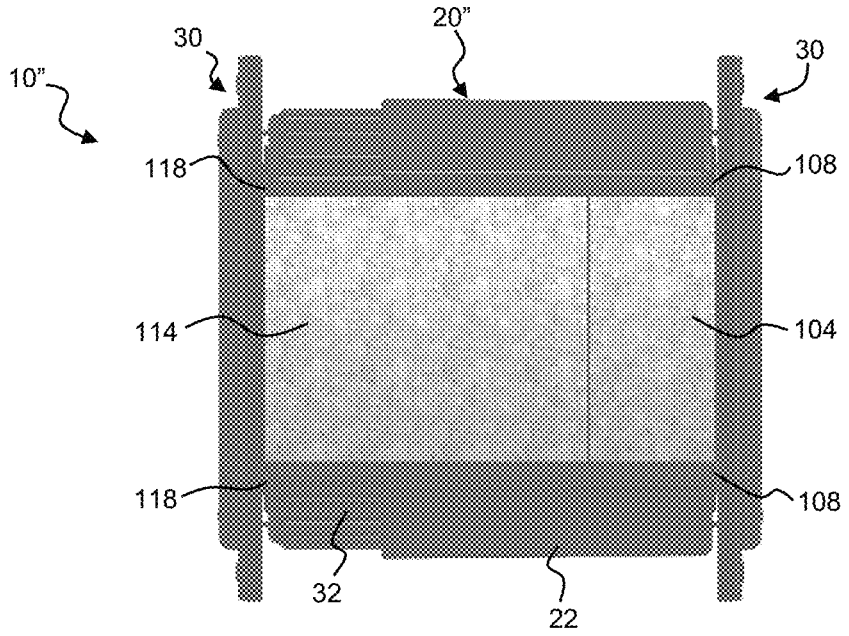
FIG. 22 is a side elevation view of the self-sealing membrane sleeve assembly of FIG. 18.
Figure 23:
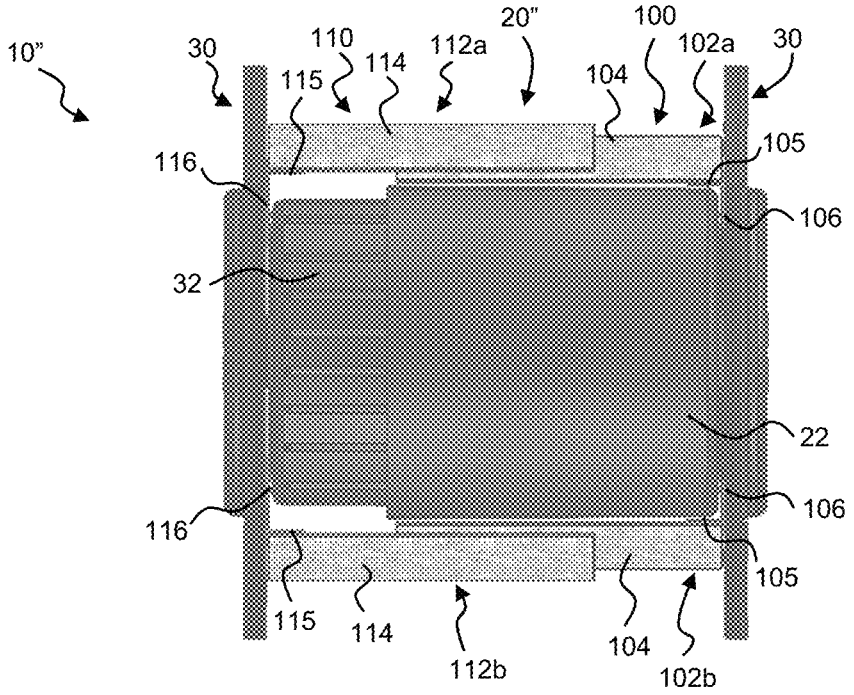
FIG. 23 is a top plan view of the self-sealing membrane sleeve assembly of FIG. 18.

Referring to FIGS. 19-21, the shield assemblies 100, 110 will be described in greater detail. The shield assemblies 100, 110 are manufactured from a fire resistant material, for example, a metal material, such that the shield assemblies 100, 110 provide structural stability to the sleeve assembly 20" even when exposed to fire or other high temperatures.

The shield assembly 100 includes a pair of opposed shield members 102*a*, 102*b*, each configured to be secured to the outer portion 22 along a respective side wall 21. In the illustrated embodiment, the shield members 102*a*, 102*b* are mirror images of one another, however, they may have different configurations. Each of the shield members 102*a*, 102*b* includes an extending portion 104 and a mounting portion 106. The extending portions 104 each have a concave arcuate configuration such that a space is defined between the inside surface 101 of each extending portion 104 and a central portion of the respective side wall 21. An intumescent pad 103 extends along the inside surface 101 of each extending portion 104 such that upon assembly the intumescent pads 103 extend between the extending portions 104 and the side walls 21.

Each mounting portion 106 generally extends at a right angle relative to the respective extending portion 104 and is configured to extend along and be mounted to the support face 25 of the outer portion 22. In the illustrated embodiment, connecting tabs 105 extend between the extending portion 104 and the mounting portion 106, however, other connection mechanisms may be utilized or the components may be manufactured as a unitary structure. In the illustrated embodiment, each mounting portion 106 includes a pair of ears 108 each defining a through hole 107 configured to align with the connector pins 46. Additionally, each mounting portion 106 includes a slot 109 configured to align with a respective alignment tab 48. As such, the sleeve members 102*a*, 102*b* are simply positioned relative to the outer portion 22 with the through holes 107 aligned with the openings 28 and the slots 109 aligned with the slots 29. Upon mounting of the outer portion 22 relative to the flange 40 of the respective sealing membrane assembly 30 as described above, the connector pins 46 and alignment tabs 48 pass through the through holes 107 and slots 109 such that the shield members 102*a*, 102*b* are securely mounted and the extending portions 104 extend along the side walls 21.

The shield assembly 110 includes a pair of opposed shield members 112*a*, 112*b*, each configured to be secured to the inner portion 32 along a respective side wall 31. In the illustrated embodiment, the shield members 112*a*, 112*b* are mirror images of one another, however, they may have different configurations. Each of the shield members 112*a*, 112*b* includes an extending portion 114 and a mounting portion 116. The extending portions 114 each have a concave arcuate configuration which complements the configuration of the respective extending portions 104 of the shield members 102*a*, 102*b*. In this way, each extending portion 114 extends along the outer surface of a respective extending portion 104 of the shield members 102*a*, 102*b* in a telescoping manner (see FIGS. 22 and 23). With this configuration, the shield members 102*a*, 102*b*, 112*a*, 112*b* form a continuous rigid, fire-rated structure extending along both sides of the outer and inner portions 22, 32.

Each mounting portion 116 generally extends at a right angle relative to the respective extending portion 114 and is configured to extend along and be mounted to the support face 35 of the inner portion 32. In the illustrated embodiment, connecting tabs 115 extend between the extending portion 114 and the mounting portion 116, however, other connection mechanisms may be utilized or the components may be manufactured as a unitary structure. In the illustrated embodiment, each mounting portion 116 includes a pair of ears 118 each defining a through hole 117 configured to align with the connector pins 46. Additionally, each mounting portion 116 includes a slot 119 configured to align with a respective alignment tab 48. As such, the sleeve members 112*a*, 112*b* are simply positioned relative to the inner portion 32 with the through holes 117 aligned with the openings 38 and the slots 109 aligned with the slots 39. Upon mounting of the inner portion 32 relative to the flange 40 of the respective sealing membrane assembly 30 as described above, the connector pins 46 and alignment tabs 48 pass through the through holes 117 and slots 119 such that the shield members 112*a*, 112*b* are securely mounted and the extending portions 114 extend along the side walls 31. It is noted that the mounting portions 116 have a larger width than the mounting portions 106 such that the extending portions 114 are positioned outward of the extending portions 104 (see FIG. 23).

Figure 24:
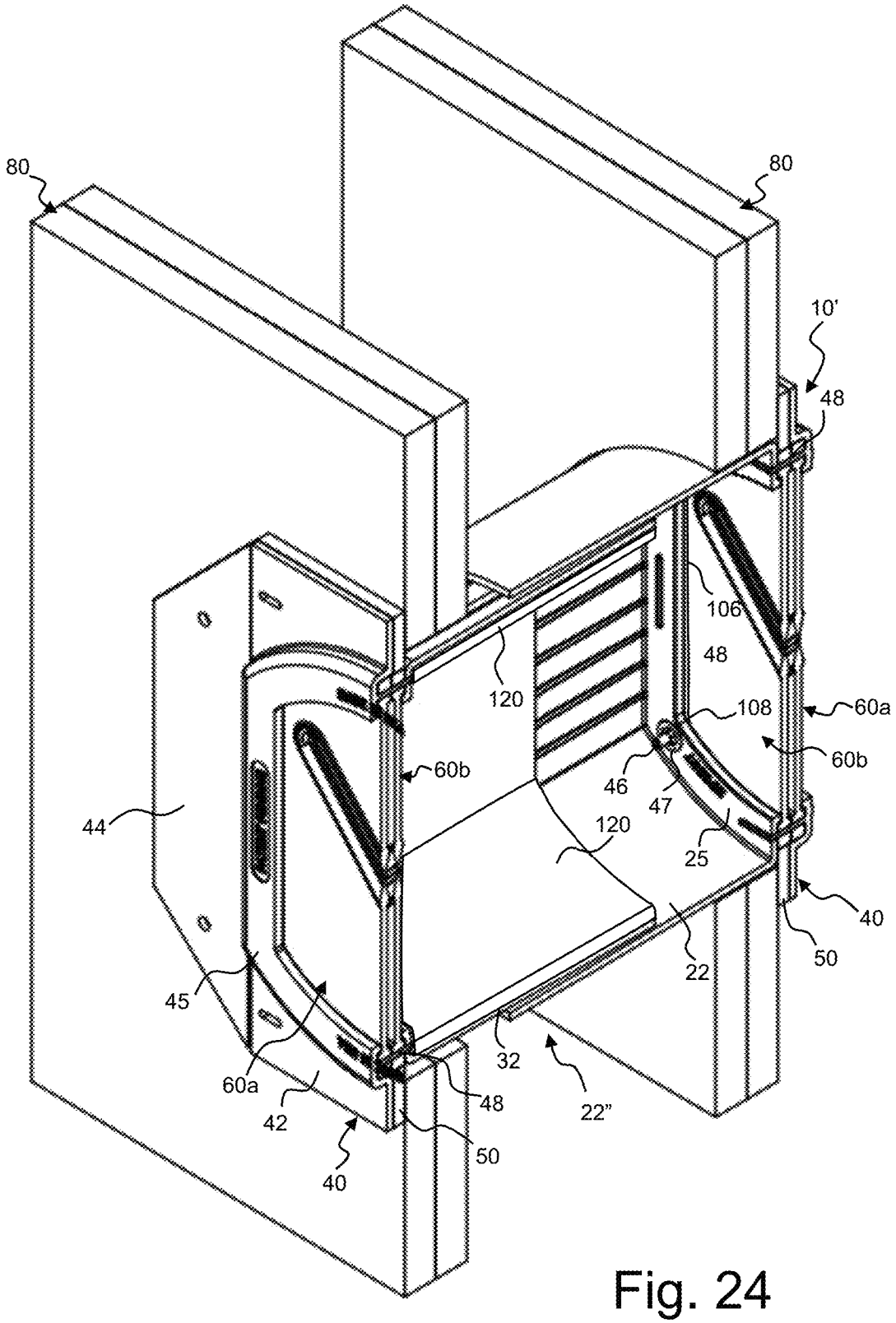
FIG. 24 is a cross-sectional view along the line 24-24 in FIG. 18.

To ensure that sufficient intumescent material is provided to expand and fill the area between the shield assemblies 100, 110 during fire or high heat, additional intumescent pads 120 may be positioned within the inner portion 32 of the sleeve assembly 20". FIGS. 19 and 24 illustrate intumescent pads 120 positioned along the inner surfaces of walls 33 of the inner portion 32. The pads 120 may be held by friction fit, adhesive or other means of securement along the walls 33. Since the intumescent pads 120 are positioned within the inner portion 32, the pads 120 do not interfere with the telescoping capability of the sleeve assembly 20". With the intumescent pads 120 aligned with the inner portion 32 and the intumescent pads 103 aligned with the outer portion 22, sufficient intumescent expansion and sealing may be achieved to fill in and seal the space defined by the shield assemblies 100, 110 even if the outer and inner portions 22, 32 melt. In other aspects, the self-sealing membrane sleeve assembly 10" is assembled and operates in a manner similar to the embodiments described above.

These and other advantages of the present invention will be apparent to those skilled in the art from the foregoing specification. Accordingly, it will be recognized by those skilled in the art that changes or modifications may be made to the above-described embodiments without departing from the broad inventive concepts of the invention. It should therefore be understood that this invention is not limited to the particular embodiments described herein, but is intended to include all changes and modifications that are within the scope and spirit of the invention as defined in the claims.

What is claimed is:

1. A self-sealing membrane sleeve assembly comprising:

a sleeve member having a tubular body extending between first and second ends and having a circumference;

at least one shield assembly extending about at least a portion of the circumference of the sleeve member from the first end to the second end, the at least one shield assembly made from a generally rigid, fire resistant material; and a first sealing membrane assembly secured to the first end of the tubular body and a second sealing membrane assembly secured to the second end of the tubular body, the first and second sealing membranes each including:

a flange having a body with a through passage;

a first sealing membrane defining a first flexible panel with a first axial sealed opening extending therethrough, the first axial sealed opening extending at an acute angle; and a second sealing membrane defining a second flexible panel with a second axial sealed opening extending therethrough, the second axial sealed opening extending at an obtuse angle;

wherein the first and second sealing membranes are secured relative to the flange such that the first and second axial sealed openings crisscross one another and the first and second sealing membranes seal the through passage except through the first and second sealed openings.

2. The self-sealing membrane sleeve assembly according to claim 1 wherein the tubular body has inner and outer portions which telescope relative to one another and the at least one shield assembly has a telescoping configuration.

3. The self-sealing membrane sleeve assembly according to claim 2 wherein the inner and outer portions of the tubular body have a friction fit therebetween.

4. The self-sealing membrane sleeve assembly according to claim 2 wherein the at least one shield assembly includes first and second shield members with the first shield member extending along the outer portion of the tubular body and the second shield member extending along the inner portion of the tubular body, the first and second shield members overlapping each other.

5. The self-sealing membrane sleeve assembly according to claim 1 wherein at least two shield assemblies extend about respective portions of the circumference of the sleeve member from the first end to the second end.

6. The self-sealing membrane sleeve assembly according to claim 5 wherein each shield assembly includes first and second shield members with the first shield member extending along the outer portion of the tubular body and the second shield member extending along the inner portion of the tubular body, the first and second shield members overlapping each other.

7. The self-sealing membrane sleeve assembly according to claim 1 wherein at least one intumescent pad extends between the shield assembly and the tubular body.

8. The self-sealing membrane sleeve assembly according to claim 1 wherein at least one intumescent pad extends within the tubular body.

9. The sealing membrane assembly according to claim 1 wherein each of the first and second axial sealed openings includes a reinforced band thereabout.

10. The sealing membrane assembly according to claim 9 wherein each reinforced band has an oval configuration.

11. A self-sealing membrane sleeve assembly comprising:

a sleeve member having a tubular body extending between first and second ends and having a circumference;

at least one intumescent pad extending within the tubular body; and a first sealing membrane assembly secured to the first end of the tubular body and a second sealing membrane assembly secured to the second end of the tubular body, the first and second sealing membranes each including:

a flange having a body with a through passage;

a first sealing membrane defining a first flexible panel with a first axial sealed opening extending therethrough, the first axial sealed opening extending at an acute angle; and a second sealing membrane defining a second flexible panel with a second axial sealed opening extending therethrough, the second axial sealed opening extending at an obtuse angle;

wherein the first and second sealing membranes are secured relative to the flange such that the first and second axial sealed openings crisscross one another and the first and second sealing membranes seal the through passage except through the first and second sealed openings.

12. The self-sealing membrane sleeve assembly according to claim 11 further comprising at least one shield assembly extending about at least a portion of the circumference of the sleeve member from the first end to the second end, the at least one shield assembly made from a generally rigid, fire resistant material.

13. The self-sealing membrane sleeve assembly according to claim 12 wherein the tubular body has inner and outer portions which telescope relative to one another and the at least one shield assembly has a telescoping configuration.

14. The self-sealing membrane sleeve assembly according to claim 13 wherein the inner and outer portions of the tubular body have a friction fit therebetween.

15. The self-sealing membrane sleeve assembly according to claim 13 wherein the at least one shield assembly includes first and second shield members with the first shield member extending along the outer portion of the tubular body and the second shield member extending along the inner portion of the tubular body, the first and second shield members overlapping each other.

16. The self-sealing membrane sleeve assembly according to claim 12 wherein at least two shield assemblies extend about respective portions of the circumference of the sleeve member from the first end to the second end.

17. The self-sealing membrane sleeve assembly according to claim 16 wherein each shield assembly includes first and second shield members with the first shield member extending along the outer portion of the tubular body and the second shield member extending along the inner portion of the tubular body, the first and second shield members overlapping each other.

18. The self-sealing membrane sleeve assembly according to claim 12 wherein at least one intumescent pad extends between the shield assembly and the tubular body.

19. The sealing membrane assembly according to claim 11 wherein each of the first and second axial sealed openings includes a reinforced band thereabout.

20. The sealing membrane assembly according to claim 19 wherein each reinforced band has an oval configuration.

* * * * *